US005118090A

United States Patent [19]

Sonoda et al.

[11] Patent Number: 5,118,090

[45] Date of Patent: Jun. 2, 1992

[54] PRINT PAPER FEEDING APPARATUS FOR USE IN PRINTER

[75] Inventors: Rikuo Sonoda, Aichi; Masatoshi Ito, Kuwana; Makoto Hattori, Nagoya, all of Japan

[73] Assignee: Brother Kogyo Kabushiki Kaisha, Nagoya, Japan

[21] Appl. No.: 615,172

[22] Filed: Nov. 19, 1990

[30] Foreign Application Priority Data

Nov. 20, 1989 [JP] Japan ..... 1-135145[U]
Nov. 20, 1989 [JP] Japan ..... 1-301394
Nov. 20, 1989 [JP] Japan ..... 1-301405

[51] Int. Cl.[5] ..... B65H 3/06

[52] U.S. Cl. ..... 271/10; 271/117; 271/127; 271/171

[58] Field of Search ..... 271/10, 114, 117, 127, 271/171; 400/625

[56] References Cited

U.S. PATENT DOCUMENTS 3,871,640 3/1975 Ritzerfeld ..... 271/114 X
4,509,734 4/1985 Rutishauser ..... 271/114 X
4,722,518 2/1988 Watanabe ..... 271/114 X
4,798,374 1/1989 Ito ..... 271/114 X
4,958,822 9/1990 Rutishauser ..... 271/114 X

FOREIGN PATENT DOCUMENTS 62-111848 5/1987 Japan .
63-288833 11/1988 Japan .

*Primary Examiner*—Richard A. Schacher
*Attorney, Agent, or Firm*—Jones, Tullar & Cooper

[57] ABSTRACT

A platen, supplemental feed rollers and a paper feed roller are driven by a motor, feeding a stack of sheet papers on a hopper one by one to the platen. When a predetermined period of time elapses after the sheet paper has reached a photosensor, the motor rotates in the reverse direction to reversely rotate the platen. The paper feed roller and the supplemental feed rollers however keep rotating to execute an oblique compensation of the paper. Then, an electromagnetic clutch is disengaged to permit the paper feed roller to freely rotate, feeding the paper to a print position by the rotation of the platen. When the power of a printer is turned off and an operational lever is moved to a paper releasing position, a switching lever oscillates, disengaging a planetary gear mechanism from other gears. This sets the supplemental feed roller free. Further, manipulating the operation lever presses down the support plate of the hopper to separate the paper from the paper feed roller, thus permitting removal of this paper.

17 Claims, 9 Drawing Sheets

PRINT PAPER FEEDING APPARATUS FOR USE IN PRINTER

BACKGROUND OF THE INVENTION

1. Field of the Invention

The present invention relates to a print paper feeding apparatus adapted to be mounted on a printer when in use.

2. Description of the Related Art

Conventional print paper feeding devices of this type are disclosed in Published Unexamined Japanese Patent Applications Nos. 62-111848 and 63-288833. The mechanism disclosed in the latter publication comprises a gear for driving a platen, a gear for driving a paper feed roller, a gear for driving a supplemental feed roller, and a planetary gear mechanism including two sets of sun gears and planetary gears. When the platen is rotated in the forward direction by a paper feeding motor, one of the planetary gears is engaged with the supplemental-feed roller drive gear and the feed-roller drive gear. Thus, rotation of the platen drive gear, which rotates together with the platen, is transmitted as rotation in the paper feeding direction to the mentioned two types of feed rollers. The rotation of both feed rollers and the rotation of the platen feeds a sheet paper toward the print section located in front of the platen.

When the platen is rotated in the reverse direction, the other planetary gear is engaged only with the supplemental-feed roller drive gear, transmitting the rotation of the platen drive gear as rotation in the paper feeding direction only to the supplemental feed roller, not to the paper feed roller.

With the above mechanism, the supplemental-roller drive gear is linked via the planetary gear mechanism to the platen drive gear. Therefore, when jamming of a sheet paper occurs between the supplemental feed roller and the platen, the jammed paper should be pulled out by an operator in a direction opposite to the paper feeding direction. However, the load of the paper feeding motor and the load of the gears are applied to the supplemental feed roller. This makes it difficult for the operator to pull out the paper. Forcibly pulling out the paper is likely to tear the paper or damage the gears.

As a solution to this shortcoming, the printer body is provided with a switching mechanism for selectively transmitting the power of a drive source to either a continuous paper feeder or a sheet paper feeder. The printer body is further provided with a releasing mechanism for disengaging the planetary gear mechanism from the aforementioned supplemental-feed roller drive gear and the feed-roller drive gear in a manner interlocked with the operation of the switching mechanism. When paper jamming occurs, the planetary gear mechanism is disengaged from these two drive gears to free the supplemental feed roller. Thus, the jammed paper can be pulled out in a direction opposite to the paper feeding direction to be removed from the printer body.

The releasing mechanism is designed to interlock with the switching mechanism of the printer body, thus complicating the overall structure of the print paper feeding apparatus.

In addition, the above paper feeding apparatus keeps the paper feed roller in constant abutment with the paper, and has no mechanism to set the feed roller free. Thus, when jammed paper is pulled in the direction opposite to the paper feeding direction, a load acting against the pulling action is applied, making it difficult to pull out the paper.

In the above apparatus, a pair of supplemental feed rollers abut against each other and always rotate during the paper feed. In other words, even in the case where continuous paper or manually-feed paper is in use and the rotation of the supplemental feed rollers is unnecessary, the supplemental feed rollers rotate and thus wear out quickly.

According to the apparatus disclosed in publication No. 63-28833, a sheet of paper is fed toward the platen via the supplemental feed rollers from the paper feed roller by the reverse rotation of the platen. When the paper sheet is caught between the supplemental feed rollers, the platen starts rotating in the forward direction. At this time, the paper feed roller is stopped and the supplemental feed rollers keep rotating to feed the paper. As a result, the paper sheet is fed by the supplemental feed rollers alone and is pulled a specific amount or length between the platen and a pinch roller located behind the platen. Then, the platen rotates in the reverse direction by an amount corresponding to the length of the paper caught, rotating the paper feed roller in the paper feeding direction. This rotation, together with the urging force in the paper feeding direction produced by the supplemental feed rollers and paper feed roller, causes the sheet paper to slack. This causes the front edge of the paper to lie on the surface of the platen in an orientation parallel to the axial direction of the platen shaft. The platen then starts rotating forwardly again, feeding the sheet paper in the print section of the printer.

In this manner, the front edge of the sheet paper is aligned in parallel to the axial direction of the platen shaft on the platen surface. This alignment is called "oblique compensation." This oblique compensation allows the sheet paper to be fed to the print section so that printing is done on the proper position on this paper.

According to the above-described apparatus, when the platen rotates forwardly, its rotation is not transmitted to the paper feed roller. At this time, the rear portion of the sheet paper is caught between the paper feed roller and the top of a stack of sheet papers on a hopper. Since the force of the paper feed roller pressing the stack of the sheet papers is relatively strong, a load is applied to the feeding of the sheet paper by the supplemental feed rollers when the paper feed roller stops rotating. As a result, the supplemental feed rollers can slip on the sheet paper in this apparatus, preventing the paper from having the proper slack. This slippage can cause the sheet paper to move obliquely, thereby preventing the front edge of the paper from accurately reaching the print section.

Another print paper feeding apparatus adapted to be mounted on a printer is disclosed in Published Unexamined Japanese Patent Application Serial No. 62-111848. The disclosed apparatus feeds sheets of paper one by one from a hopper by the paper feed roller in the same manner as described above. The paper is then held between a pair of the supplemental feed rollers and is fed in that state. The supplemental feed rollers are pressed against each other in order to hold the paper as in the case of the apparatus disclosed in the aforementioned publication No. 63-288833.

Supplemental roller shafts to support respective supplemental feed rollers rotatable are supported at both ends by the side frames of the print paper feeding apparatus, causing a slack at the center of each supplemental roller shaft. As the paper feeding is repeated, therefore, the interval between the supplemental roller shafts becomes wider particularly from their center portions, making a gap between the supplemental roller shafts at the respective ends of the supplemental feed rollers. This gap reduces the pressing force between the supplemental feed rollers and make the paper-feeding force insufficient.

In a case of feeding a paper only by the supplemental feed rollers with the paper feed roller not rotating, the supplemental feed rollers require large paper-feeding force. It is not therefore possible to surely feed the paper in that condition, causing a skew or paper jamming.

SUMMARY OF THE INVENTION

It is therefore an object of the present invention to provide a print paper feeding apparatus capable of always accurately and surely feeding a sheet of paper.

It is another object of the present invention to provide a print paper feeding apparatus which can ensure easy removal of jammed paper with a simple and compact mechanism, and inhibits the supplemental feed rollers, when not needed, from becoming a load, thus reducing wear in the supplemental feed rollers to the extent possible.

It is a further object of the present invention to maintain a constant pressing force between a pair of supplemental feed rollers to ensure excellent paper feeding.

According to one aspect of the present invention, a sheet feeding apparatus is provided that includes a platen for supporting a sheet paper and rotating in a paper feeding direction when driven by a drive source. A hopper retains a stack of sheet papers. The hopper includes a support plate that supports a sheet. A paper feed roller separates the sheet papers on the hopper one by one and feeds the individual sheets toward the platen. Supplemental feed rollers feed the sheet paper fed by the paper feed roller to the platen. A transmission means rotates the paper feed roller and the supplemental feed rollers in the paper feed direction. The transmission means is coupled to the drive source. A manually-operable lever moves the support plate in a direction away from the paper feed roller. Additionally, a disengaging mechanism is provided between the operational lever and the transmission means, for transmitting movement of the lever to the transmission means to disengage the transmission means from the paper feed roller and the supplemental feed rollers.

According to a second aspect of the invention, the paper feeding apparatus has transmission means including a first transmission mechanism that transmits drive force from the drive source to rotation of the supplemental feed rollers in the paper feeding direction when the platen is rotating. A second transmission mechanism transmits drive force from the drive source into rotations of the paper feed roller in the paper feeding direction. Additionally an electromagnetic clutch inhibits transmission of the rotation by the second transmission mechanism.

According to a third aspect of the present invention, the hopper has side walls movable in a width direction of the paper. A feed roller shaft holds the paper feed roller and supplemental roller shafts hold the first and second supplemental feed rollers in the same manner. The paper feed roller and the supplemental feed rollers are movable on their shafts in a manner interlocked with movement of the side walls. The apparatus further includes a shaft interval holding means, provided at a vicinity of the first and second supplemental feed rollers, for keeping a constant interval between the first and second supplemental roller shafts. The shaft interval holding means is movable in a manner interlocked with movement of the side walls.

DETAILED DESCRIPTION OF THE PREFERRED EMBODIMENT

Figure 1:
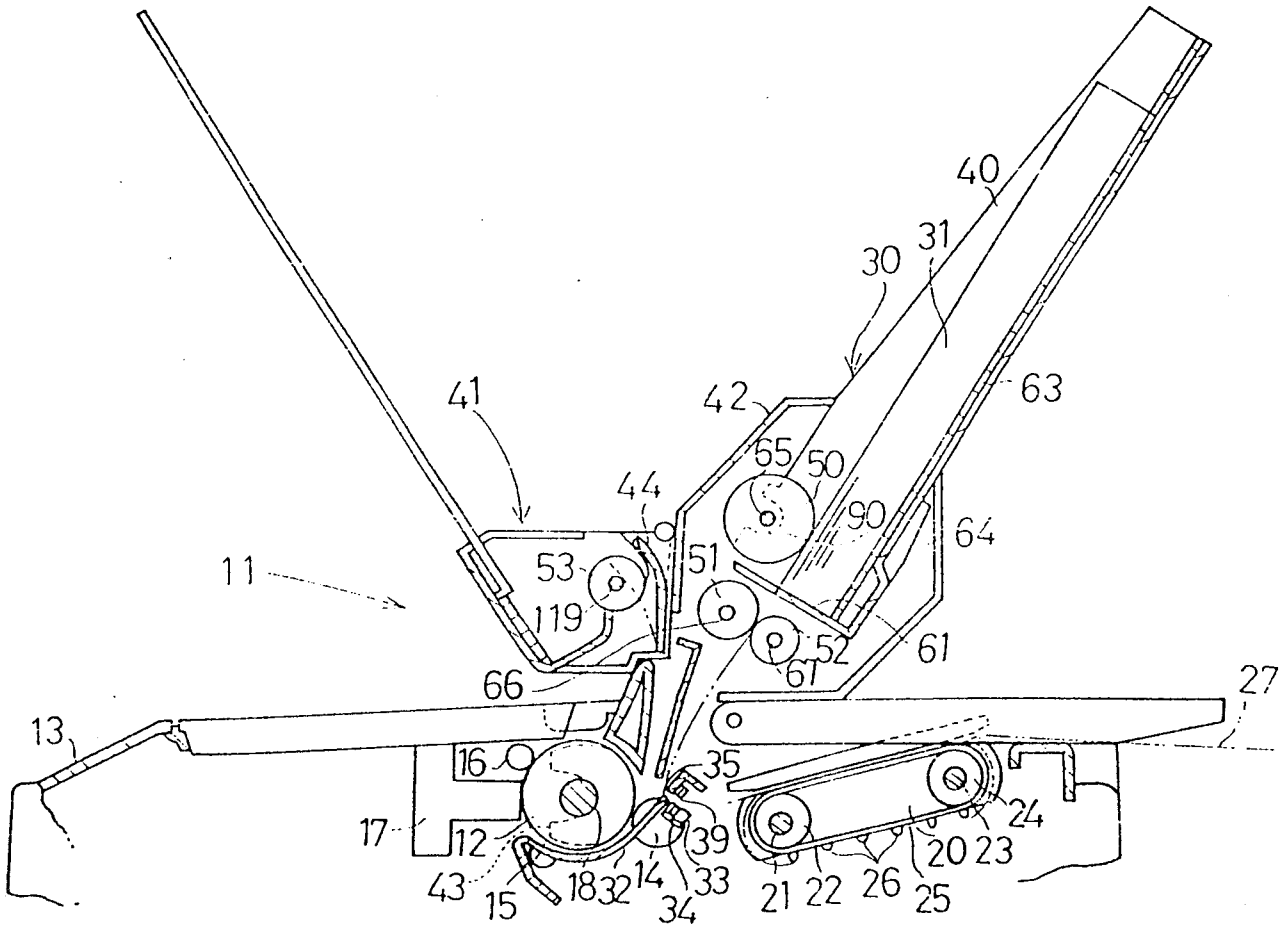
FIG. 1 is a cross-sectional view illustrating a print paper feeding apparatus in accordance with the present invention mounted on a printer.
Figure 2:
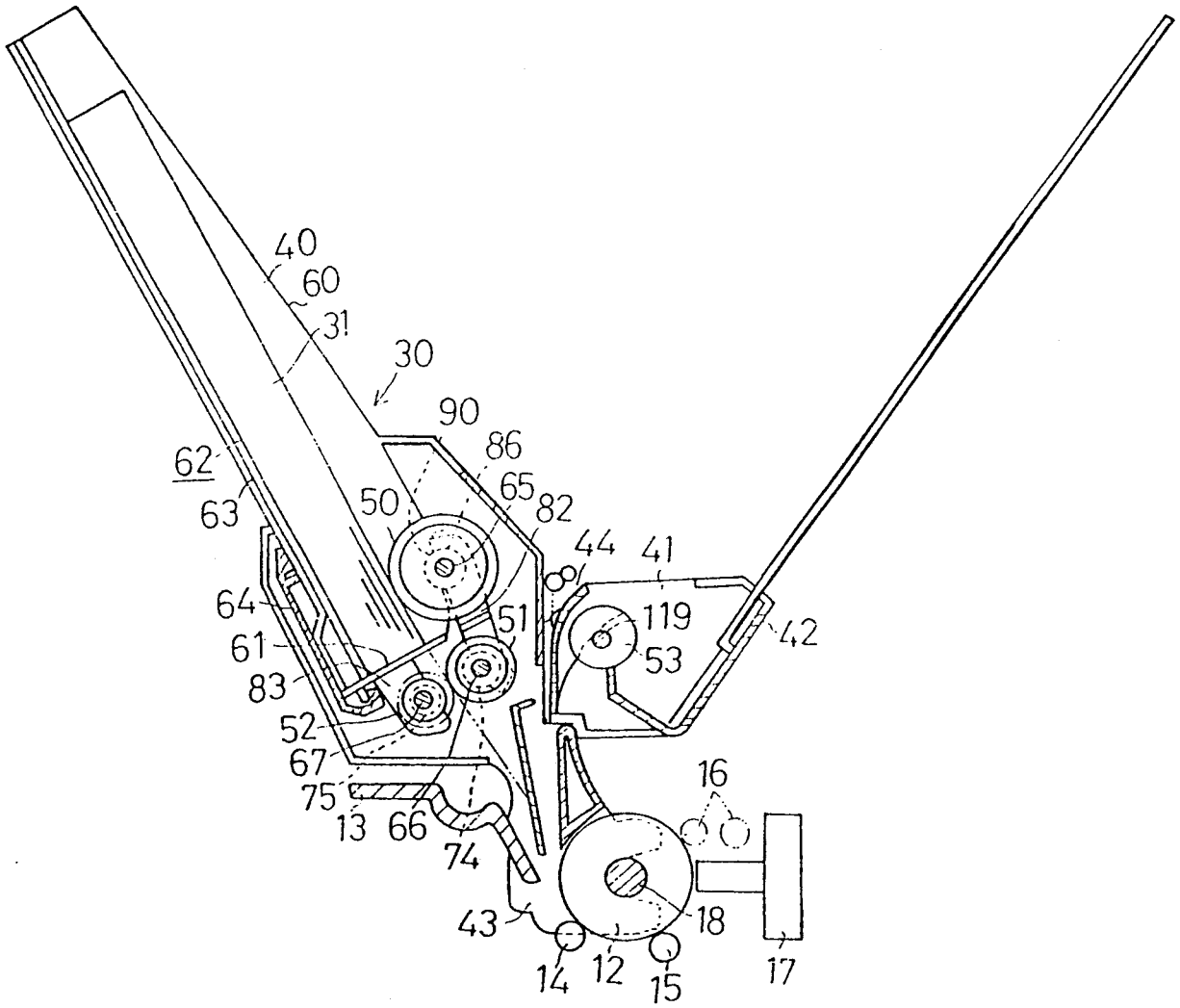
FIG. 2 is a cross-sectional view of the print paper feeding apparatus as viewed from the opposite side to FIG. 1.

A preferred embodiment of the present invention will now be described referring to the accompanying drawings. As illustrated in FIGS. 1 and 2, a platen 12, which is driven by a paper feeding motor (not shown), is supported on a printer frame 13 inside a printer 11. Around the platen 12 are arranged a first pinch roller 14, a second pinch roller 15, and a paper positioning roller 16. The individual rollers 14 to 16 rotate with the rotation of the platen 12, and feed a print paper along the outer surface of the platen 12 in cooperation with the platen. A printing head 17 which records characters and/or patterns on the print paper is disposed in front of the platen 12. This printing head 17 is mounted on a carriage (not shown) which is movable in the axial direction of the platen 12. Behind the platen 12 lies a pin tractor 20 for feeding a continuous paper 27 to the platen 12. A sheet paper feeder 30 is installed above the platen 12.

The pin tractor 20 comprises, as its essential elements, a drive shaft 21 rotatable by the drive force of the motor, a drive pulley 22 secured to the drive shaft 21, a rotatable guide shaft 23, a driven pulley 24, fixed to the guide shaft 23, a pin belt 25, which is set between pulleys 22 and 24 and rotates with the rotation of the drive pulley 22. With pins 26 of the pin belt 25 engaged with feed holes (not shown) of the continuous paper 27, the pin belt 25 makes a circuit motion, feeding the paper 27 toward the platen 12. The printer is designed in such a manner that when a sheet paper 31 is fed by the sheet paper feeder 30, the drive force from the motor is not transmitted to the drive shaft 21 of the pin tractor 20.

The motor, constituted by a stepping motor, rotates in synchronism with a pulse signal from a controller (not shown) that controls the drive system and the electric signal system of the printer 11. Since the structure and operation of this controller as used in the printer are well known, its description will be omitted.

At the vicinity of the first pinch roller 14 a paper guide plate 32 is disposed which guides the fed-out sheet paper 31 along the outer surface of the platen 12. A photosensor 33 for detecting the sheet paper 31 reaching a predetermined position is secured to part of the paper guide plate 32 by means of a sensor support 34. The photosensor 33 is of a reflection type which emits light toward a print paper via through holes 35 and 39 respectively formed in the paper guide plate 32 and the sensor support 34, and detects the arrival of the sheet paper 31 by the presence or absence of the reflection light. The photosensor 33 outputs a detection signal which is supplied to the controller. Upon reception of this detection signal, the controller starts counting the number of output pulses to the motor, and outputs a control signal when counting a predetermined number (PN) of the pulses to thereby render an electromagnetic clutch 138 (which will be described later) in an inhibited state.

As illustrated in FIGS. 1 to 4, the sheet paper feeder 30 has a hopper 40 for retaining a stack of sheet papers 31, and a stacker 41 for retaining the sheet paper 31 fed out from the platen 12. Connecting arms 43 extending downward are provided on respective sides of side frames 42 which support the hopper 40 and the stacker 41. The connecting arms 43 when detachably engaged with a platen shaft 18 of the platen 12, support the sheet paper feeder 30 detachable on the printer frame 13. At the vicinity of the bottom of the hopper 40 is located paper feed rollers 50 for separating the sheet papers 31 on the hopper 40 one by one and feeding the separated paper toward the platen 12. Downstream of the paper feed rollers 50, a pair of supplemental feed rollers 51 and 52 are disposed which feed the sheet paper 31, fed out from the paper feed rollers 50, to the platen 12. At the vicinity of the bottom of the stacker 41 is disposed a roller 53 for feeding the sheet paper 31 fed from the platen 12 to the stacker 41. These rollers 50 to 53 are driven by the drive force of the platen 12 transmitted via first and second gear mechanisms 100 and 130 (to be described later).

Figure 6:
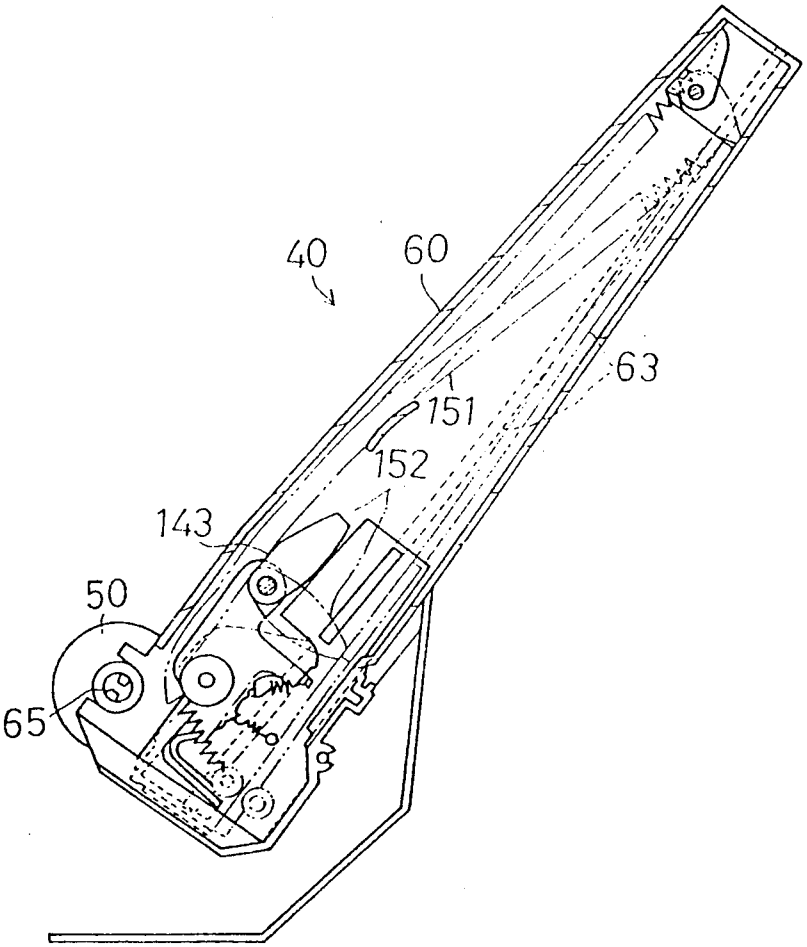
FIG. 6 is a cross-sectional view showing the interior of the side wall of a hopper.
Figure 7:
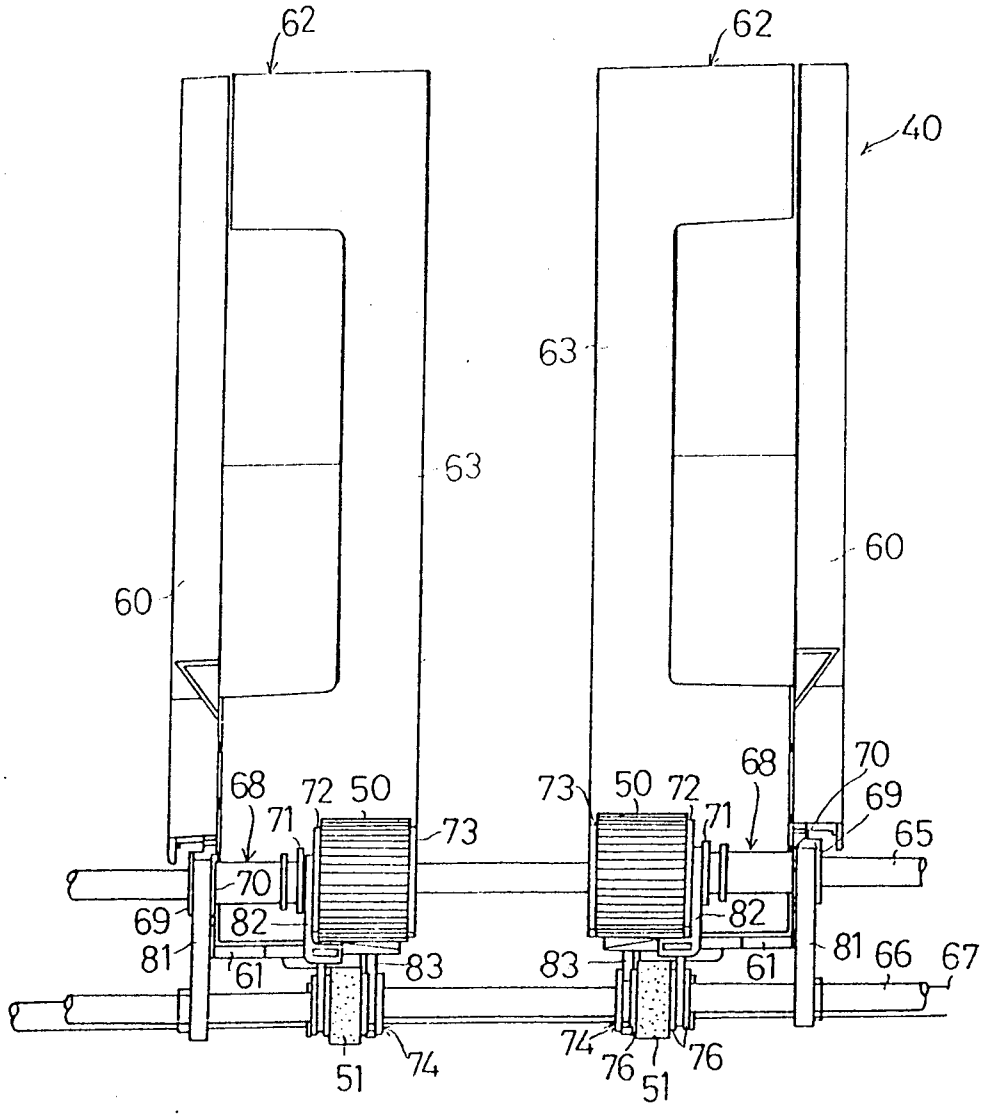
FIG. 7 is a front view of the hopper shown in FIG. 6.

As shown in FIGS. 6 and 7, the hopper 40 comprises a pair of hopper sections 62 which retain a stack of sheet papers 31. The hopper sections 62 are supported slidable in the paper width direction on a rail 64 laid between the side frames 42. Each hopper section 62 has a side wall 60 for supporting the side edge of the sheet paper 31, a bottom plate 61 for supporting the bottom of the sheet paper 31, and a back plate 63 for supporting the sheet paper from the back.

A paper feed roller shaft 65 and first and second supplemental roller shafts 66 and 67 are rotatably mounted between the side frames 42. A pair of feed roller holders are fitted over the paper feed roller shaft 65 rotatable with the shaft 65 and slidable in the axial direction thereof.

Each feed roller holder 68 has flanges 69 to 73 formed thereon. A rubber ring is fitted on the holder 68 between the flanges 72 and 73, constituting the paper feed roller 50. A pair of a first supplemental roller holder 74 and a second supplemental roller holder 75 are fitted over each of the shafts 66 and 67 rotatable with the associated shaft 66 or 67 and slidable in the axial direction thereof.

The first supplemental roller holder 74 has four flanges 76 formed thereon, with a rubber ring fitted between the inner two flanges 76, constituting the first supplemental feed roller 51. Likewise, the second supplemental roller holder 75 has four flanges 79 formed thereon, with a rubber ring fitted between the inner two flanges 79, constituting the second supplemental feed roller 52.

Figure 8:
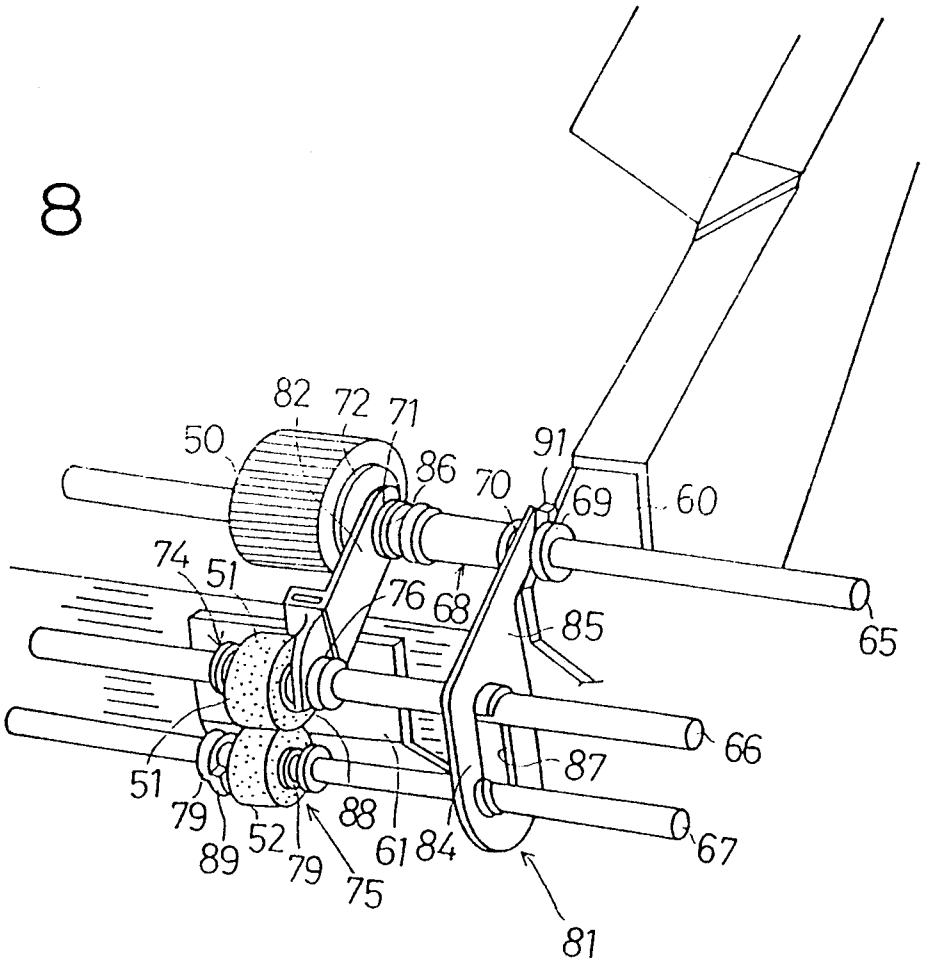
FIG. 8 is a perspective view illustrating portions of a paper feed roller and a supplemental feed roller.

As shown in FIGS. 2, 7 and 8, shaft supports 81 each comprises a longitudinally elongated body portion 84 and an arm portion 85 extending from the top of the body portion 84 toward the paper feed roller shaft 65. A semicircular notch 91 of the arm portion 85 is coupled between the flanges 79 and 80 of the feed roller holder 68 which is rotatable in relation thereto. The body portion 84 has an opening 87 formed therein to match the diameters of the shafts 66 and 67. The upper and lower portions of the opening 87 are made semicircular to receive the shafts 66 and 67 relatively rotatable and slidable in their axial direction. This can suppress the gap between the shafts 66 and 67 as much as possible, always keeping the shaft gap at the vicinity of the supplemental feed rollers 51 and 52 constant.

A semicircular notch 86 formed at one end of a first arm 82 is coupled between the flanges 71 and 72 of the feed roller holder 68 rotatable in relation to the holder 68, while another semicircular notch 88 formed on the other end is coupled rotatable between the outer flanges 76 of the first supplemental roller holder 74.

A second arm 83 is formed integral with the bottom plate 61 of the hopper 40, as shown in FIG. 2. A semicircular notch 89 formed at the free end of the second arm 83 is coupled relatively rotatable between the outer flanges 79 of the second supplemental roller holder 75. A semicircular notch 90 is formed at the front bottom of the side wall 60 of the hopper 40, the side wall 60 coupled relatively rotatable between the flanges 69 and 70 of the feed roller holder 68.

Figure 3:
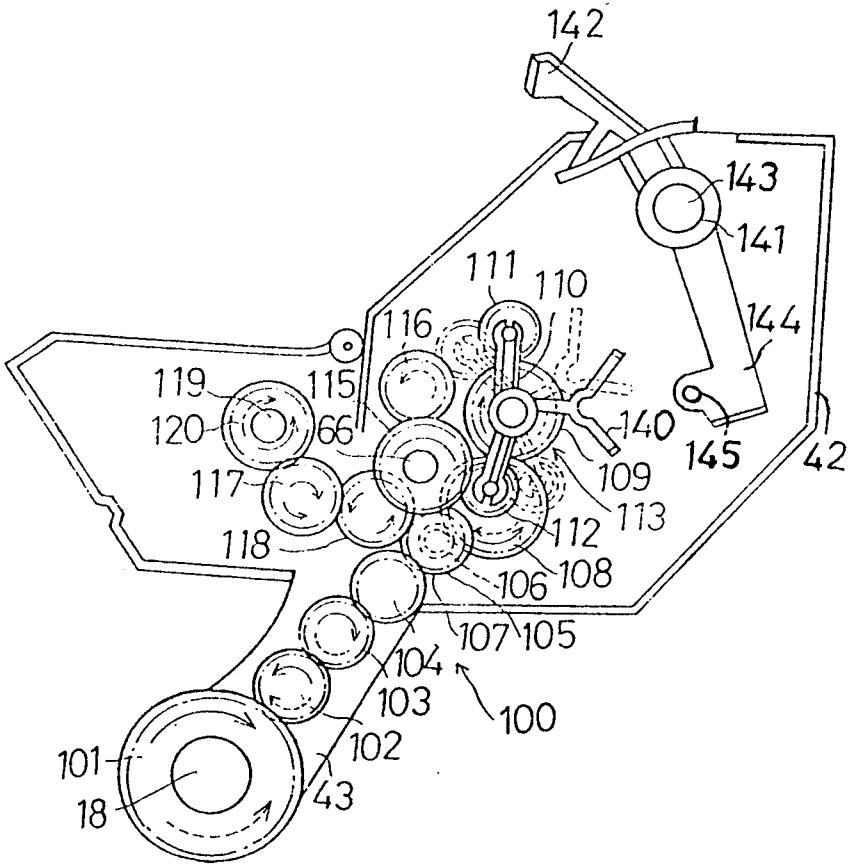
FIG. 3 is a side view illustrating the gearing in the print paper feeding apparatus.
Figure 4:
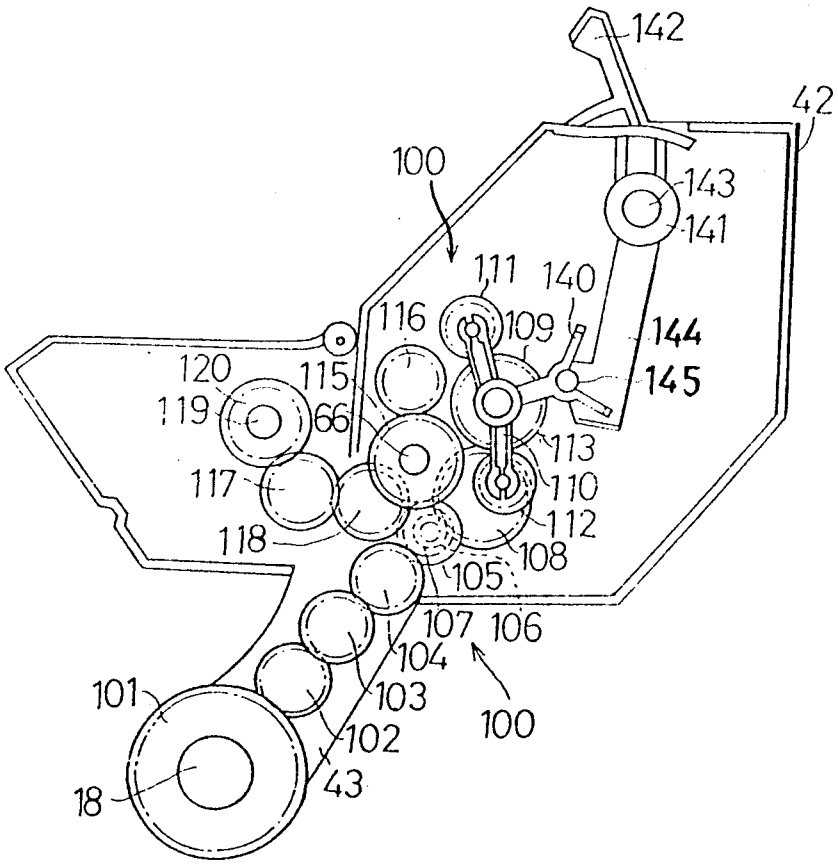
FIG. 4 is a cross-sectional view illustrating the first gear mechanism in an inhibited state.

As illustrated in FIGS. 3 and 4, the first gear mechanism serving as a first transmission mechanism is disposed in one side frame 42 of the sheet paper feeder 30. When the sheet paper feeder 30 is mounted on the printer 11, the first gear mechanism 100 is coupled to a platen drive gear 101 secured to the shaft 18 of the platen 12.

The first gear mechanism 100 comprises a plurality of gears. They include transfer gears 102, 103 and 104, a double gear 107 including a primary gear 105 and a secondary gear 106, an idle gear 108, a planetary gear mechanism 113 including a sun gear 109 and two planetary gears 111 and 112, a supplemental roller drive gear 115, a supplemental idle gear 116, two idle gears 117 and 118, and a feed gear 120. The transfer gears 102 to 104, when engaged with the platen drive gear 101, receive the rotation thereof. The primary gear 105 is engaged with the transfer gear 104, and the secondary gear 106 is engageable with the idle gear 108. The sun gear 109 is engageabe with the idle gear 108. The planetary gears 111 and 112 are coupled via an oscillating arm 110 to the sun gear 109. The supplemental roller drive gear 115 is secured to the shaft 66. The supplemental idle gear 116 is engageable with the gear 115. The idle gears 117 and 118 are coupled to the primary gear 105. The feed gear 120 is engaged with the idle gear 117 and secured to a shaft 119 of the roller 53.

When the platen 12 rotates in the forward direction or in the direction of the solid arrow in FIG. 3, the planetary gear 112 in the planetary gear mechanism 113 engages with the supplemental roller drive gear 115 with the clockwise rotation of the sun gear 109 as indicated by the solid line. When the platen 12 rotates in the reverse direction or in the direction of the broken arrow, the planetary gear 112 engages with the supplemental idle gear 116 with the counterclockwise rotation of the sun gear 109 as indicated by the broken line. Irrespective of the forward or reverse rotation of the platen 12, therefore, the supplemental roller drive gear 115 rotates only clockwise or in the paper feeding direction.

Figure 5:
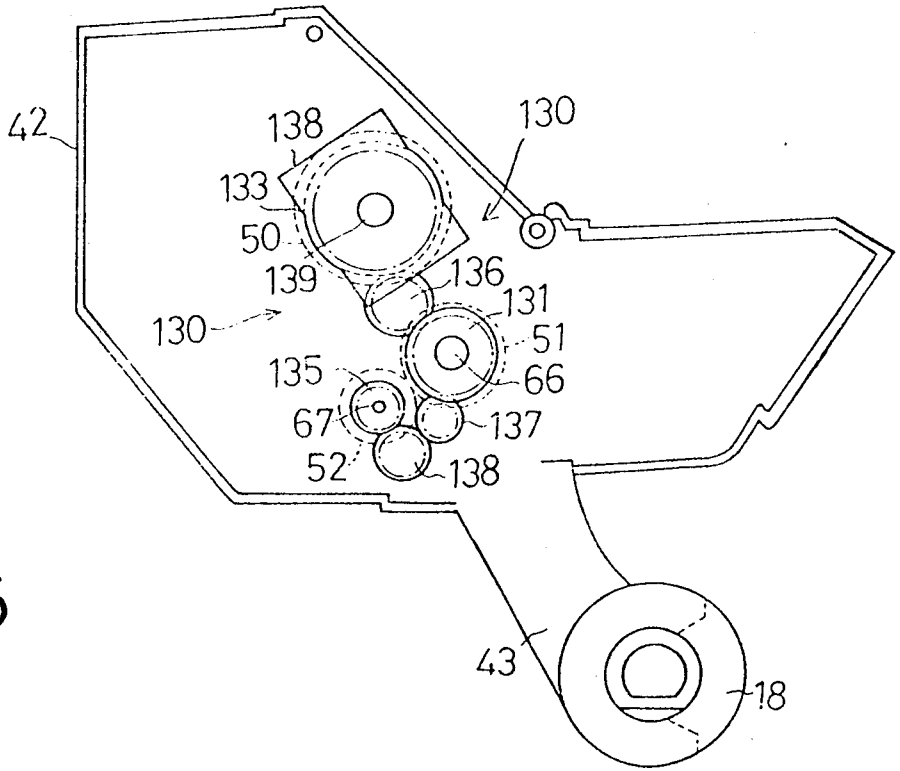
FIG. 5 is a side view of a second gear mechanism.

As shown in FIG. 5, the second gear mechanism 130 serving as a second transmission mechanism is disposed in the other side frame 42. The second gear mechanism 130 comprises a supplemental roller gear 131 secured to the other end of the shaft 66 of the first supplemental feed roller 51, a paper feed roller drive gear 133 secured to another shaft 139 on the same axis of the shaft 65 of the paper feed roller 50, a supplemental roller driven gear 135 secured to the shaft 67 of the second supplemental feed roller 52, a paper feed idle gear 136 engageable with the supplemental roller gear 131 and the drive gear 133, and two transfer gears 137 and 138 which transmit the rotation of the supplemental roller gear 131 to the driven gear 135.

The electromagnetic clutch 138 is disposed between the paper feed roller shaft 65 and the shaft 139.

The second supplemental feed roller 52 rotates in the paper feeding direction in synchronism with the rotation of the first supplemental feed roller 51, and the shaft 139 and the paper feed roller shaft 65 rotate together by the coupling action of the electromagnetic clutch 138, thus rotating the paper feed roller 50 in the paper feeding direction. The coupling and disengaging of this clutch 138 are controlled by a control signal from the controller. At the time the electromagnetic clutch 138 is in the disengaged or inhibited state, the paper feed roller shaft 65 is freely rotatable to the shaft 139.

As illustrated in FIGS. 3 and 4, a nearly Y-shaped switch lever 140 is secured to the center of the oscillating arm 110 of the planetary gear mechanism 113. In the side frame 42, a mode selection lever 141 is supported rotatable around a shaft 143, and is positioned to a paper setting position in FIG. 3 or a paper releasing position in FIG. 4. The shaft 143 is bridged between the side frames 42, penetrating the side wall 60 of the hopper 40.

The mode selection lever 141 is located away from the switching lever 140 when its actuating portion 144 is at the paper setting position. When the actuating portion 144 is at the paper releasing position, a protrusion 145 provided at the distal end of the actuating portion 144 is fitted in the Y-shaped portion of the switching lever 140. The switching lever 140 is located in one of the two positions, indicated by the solid line and the two-dot chain line in FIG. 3. When the protrusion 145 of the actuating portion 144 abuts on one inclined surface of the Y-shaped portion, the oscillating arm 110 oscillates, disengaging both planetary gears 111 and 112 from the supplemental idle gear 116 and the drive gear 115. When the protrusion 145 is disengaged from the Y-shaped portion, the planetary gears 111 and 112 engage with one of the supplemental idle gear 116 and the drive gear 115.

As shown in FIGS. 6 and 7, the bottom of the back plate 63 of the hopper section 62 is swingable with its top as a fulcrum in the directions approaching and moving away from the paper feed roller 50. The back plate 63 is urged toward the paper feed roller 50 by a spring 151 connected to the bottom of the back plate.

A cam 152 is disposed in the side wall 60 of the hopper section 62. The cam 152 is fitted on the shaft 143 of the mode selection lever 141, and is slidable on the shaft 143 together with the side wall 60 or rotatable together with the shaft 143, in accordance with the movement of the hopper section 62 in the paper width direction. When the mode selection lever 141 is set to the paper releasing position, the cam 152 rotates to the position indicated by the two-dot chain line in FIG. 6, pressing the back plate 63 down to the position indicated by the two-dot chain line. As a result, space is formed between the paper feed roller 50 and the back plate 63, permitting removal or insertion of the sheet paper 31. When the mode selection lever 141 is set to the paper setting position, the cam 152 rotates to the position indicated by the solid line, and the back plate 63 is moved toward the paper feed roller 50 due to the action of the spring 151, pressing the top of the stack of sheet papers 31 against the paper feed roller 50.

The function of the thus constituted print paper feeding apparatus will be described below. When the hopper section 62 of the hopper 40 is moved to set its side walls 60 to match the width of the sheet paper 31, the shaft support 81, the first arm 82, and the second arm 83 allow the feed roller holder 68, the first supplemental roller holder 74 and the second supplemental roller holder 76 to slide together on the respective shafts in the axial direction. Accordingly, the paper feed rollers 50, the first supplemental feed roller 51 and the second supplemental feed roller 52 also move together. At this time, the shaft support 81 always keeps the gap between the shafts 66 and 67 constant, thereby always maintaining the pressing force between the supplemental feed rollers 51 and 52. Since the individual rollers 50 and 52 are interlocked with the lateral movement of the hopper 40, the hopper 40 can surely feed out the sheet papers 31 of different paper widths.

Although each shaft support 81 as the shaft-interval holding member is constituted as described eariler in this embodiment, it is not restricted to that particular shape as long as it can always keep the gap between the supplemental feed rollers 51 and 52 constant and is movable in the axial direction of the shafts 66 and 67 interlockingly with the movement of the side walls 60 of the hopper 40 in the axial direction.

Figure 9:
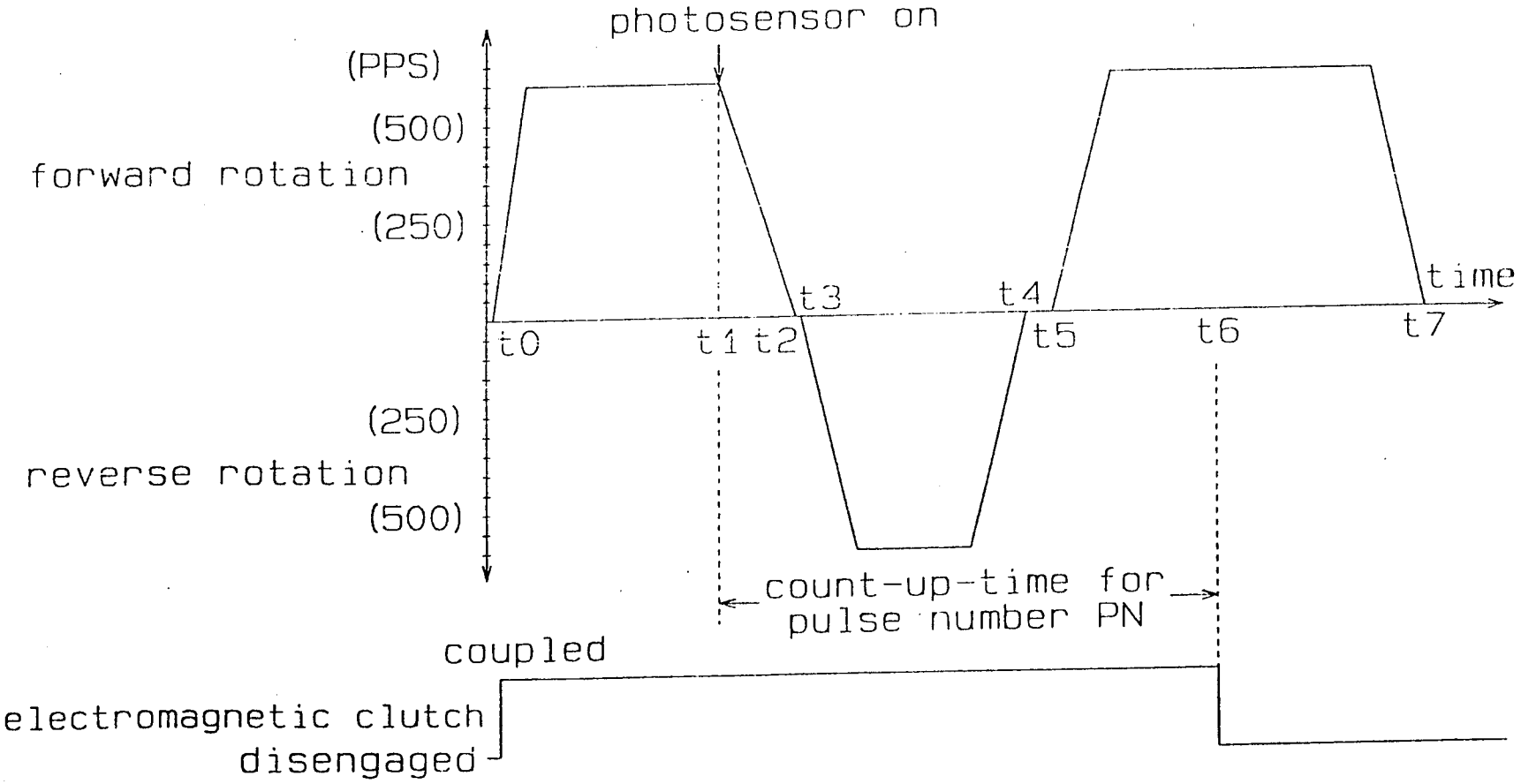
FIG. 9 is a graph illustrating the rotational timing of a paper feeding motor.

The operation of the sheet paper feeder 30 will be discussed below. FIG. 9 is an explanatory diagram showing the timing at which the motor rotates forward or in reverse.

When the motor is activated forwardly to rotate the platen 12 in the forward direction (t0), it runs in slow-up mode and runs at a constant speed after its speed reaches a predetermined velocity (e.g., 600 PPS). At this time, the supplemental feed rollers 51 and 52 rotate in the paper feeding direction and the electromagnetic clutch 138 is set in the coupled state, causing the paper feed rollers 40 to rotate in the paper feeding direction. As a result, the sheet paper 31 is fed to the platen 12. When the front edge of the sheet paper 31 reaches the photosensor 33, activating it at (t1), the motor starts a slow-down operation and rotates by a predetermined number of steps while decelerating to an eventually stop at (t2). At this time, the front edge of the sheet paper 31 has not yet reached between the platen 12 and the first pinch roller 14. After an instantaneous stop, the motor is reactivated to rotate in the reverse direction at (t3), and stops at (t4) after rotating a predetermined number of steps. In this course of action, the platen 12 rotates in the reverse direction and the paper feed rollers 50 and the supplemental feed rollers 51 and 52 rotate forwardly. Therefore, the front edge of the sheet paper 31 comes between the platen 12 and the first pinch roller 14. This causes a slack on the sheet paper 31 to perform the oblique compensation of the paper 31.

After a slight stop. the motor is activated to rotate in the forward direction at (t5), and stops at (t7) after rotating a predetermined number of steps. In this course of action, the platen 12 and the supplemental feed rollers 51 and 52 rotate forwardly, feeding the sheet paper 31 to the second pinch roller 15 from the first pinch roller 14. Immediately thereafter, i.e., after the photosensor 33 is activated, when the number of pulses output from the controller reaches a predetermined number (PN), the electromagnetic clutch 138 is disengaged at (t6). At this point of time, therefore, the paper feed rollers 50 are released from the driving force and become freely rotatable, permitting the sheet paper 31, while firmly held between the first and second pinch rollers 14 and 15, to be accurately fed to the position where printing is to be done by the printing head 17. The sheet paper 31 stops moving when it reaches this position.

According to this embodiment, in the above operation, the rotation of the supplemental feed roller 51 is transmitted to the paper feed rollers 50 via the first and second gear mechanisms 100 and 130 and the electromagnetic clutch 138.

The paper feed rollers 50 would not act as a load to the paper feeding after the electromagnetic clutch 138 is disengaged. Accordingly, the supplemental feed rollers 51 and 52 do not slip, thus surely feeding the sheet paper 31 to the printing head 17.

According to this embodiment, the rotation of the platen 12 is transmitted to one end of the shaft 66, and is further transmitted to the paper feed rollers 50 from the other end of the shaft 66, simplifying the structure to match the rotational directions of the supplemental feed roller 51 and the paper feed rollers 50. Further, it is possible to distribute the gears to both side frames 42, making the sheet paper feeder compact.

In addition, since the rotation of the paper feed rollers 50 is transmitted from the supplemental feed roller 51 which is always rotated in the paper feeding direction, the paper feed rollers 50 do not stop rotating when the rotational direction of the platen 12 is switched. It is therefore possible to stop rotating the paper feed rollers 50 by means of the electromagnetic clutch 138 after a single sheet paper 31 is surely fed to the platen 12, thereby inhibiting the subsequent sheet of paper from being fed out. This can ensure feeding of the sheet papers one by one.

In feeding a sheet paper of a short length, such as a post card, the number (PN) of pulses to be counted should be adjusted after the photosensor 33 is activated, and the electromagnetic clutch 138 should be disengaged immediately after the rear edge of the sheet paper passes the paper feed rollers 50. Such adjustment of the timing for disengaging the electromagnetic clutch 138 can inhibit the paper feed rollers 50 to subsequently feed the next sheet of paper.

When the sheet paper 31 is jammed near the supplemental feed rollers 51 and 52 in the printer and the print paper feeding apparatus with the above-described structures, the power of the printer 11 should be turned off first, then the motor should be stopped.

When the mode selection lever 141 is set to the paper releasing position as shown in FIG. 4, the protrusion 145 of the lever 141 oscillates the switching lever 140 of the planetary gear mechanism 113. This disengages the planetary gear 111 from the drive gear 115 and the planetary gear 112 from the supplemental idle gear 116, setting the planetary gears 111 and 112 at the neutral position. As a result, the drive gear 115 is disengaged from the platen 12. The movement of the mode selection lever 141 to the paper releasing position causes the cam 152 to press down the back plate 63 of the hopper 40, separating the top of the stack of sheet papers 31 from the paper feed rollers 50.

It therefore becomes easier to pull out the rear edge of the jammed sheet paper from the hopper 40 in the rear direction or in the direction opposite to the paper feeding direction. If the supplemental feed rollers 51 and 52 reversely rotate due to the friction with that paper, the rollers 51 and 52 would rotate freely without any load of the gear mechanism 100 or the motor acting thereon. As a result, the jammed paper can be pulled out without any trouble in the direction opposite to the paper feeding direction. Further, no force would be applied to the supplemental feed rollers 51 and 52 at the time the sheet paper 31 is pulled out, thus preventing the supplemental feed rollers 51 and 52 and the gear mechanisms 100 and 130 from being damaged.

The mechanism for switching the planetary gears 111 and 112 of the planetary gear mechanism 113 to the direction of releasing the transmission of the rotation has a very simple structure. It only includes the Y-shaped switching lever 140 provided on the arm 110 that supports the planetary gears 111 and 112, and the protrusion 145 provided on the mode selection lever 141. In addition, the releasing operation can be executed using the mode selection lever 141 which is provided to move the back plate 63 vertically, this mechanism can be realized by simple modification of the existing print paper feeding apparatus.

In feeding the continuous paper 27 using the pin tractor 20 or manually inserting a single sheet paper 31 from a clearance 44 between the printer frame 13 and the stacker 41, manipulating the mode selection lever 141 to the releasing position can prevent the rotation of the platen 12 from being transmitted to the supplemental feed rollers 51 and 52 and the paper feed rollers 50. It is therefore possible to inhibit the rollers 50, 51 and 52 from becoming a load to the rotation of the platen 12, and prevent the rotation of the supplemental feed rollers 51 and 52 when they are not necessary, thus reducing the wearing out of the rollers 51 and 52.

What is claimed is:

1. A sheet feeding apparatus comprising:

a platen for supporting a sheet paper and rotating in a paper feeding direction when driven by a drive source;

a hopper for retaining a stack of sheet papers, the hopper including a support plate that supports a sheet;

a paper feed roller for separating the sheet papers on the hopper one by one and feeding the individual sheets toward the platen;

supplemental feed rollers for feeding the sheet paper fed by the paper feed roller to the platen;

a transmission means for rotating the paper feed roller and the supplemental feed rollers in the paper feeding direction, the transmission means being coupled to said drive source;

a manually-operable lever for moving the support plate in a direction away from the paper feed roller; and a disengaging mechanism, provided between the lever and the transmission means, for transmitting movement of the lever to the transmission means to disengage the transmission means from the paper feed roller and the supplemental feed rollers.

2. A sheet feeding apparatus according to claim 1, wherein there are a pair of supplemental feed rollers which rotate to pass the sheet paper therebetween.

3. A sheet feeding apparatus according to claim 2, wherein: the supplemental feed rollers are carried by supplemental feed roller shafts; and the hopper has a shaft interval holding means for acting on the supplemental feed roller shafts to inhibit their separation.

4. A sheet feeding apparatus according to claim 1, wherein the transmission means includes:

a first transmission mechanism for transmitting the drive force of the drive source to the supplemental feed rollers; and a second transmission mechanism for transmitting the rotation of the supplemental feed rollers to the paper feed roller.

5. A sheet feeding apparatus according to claim 4, wherein the first transmission mechanism includes a sun gear and planetary gears designed to engage feed roller gears coupled to one of the supplemental feed rollers to thereby transmit rotation of the sun gear to the supplemental feed roller; and when the disengaging mechanism is actuated by operation of the lever, the planetary gears are disengaged from the feed roller gears to inhibit the transmission of rotation therebetween.

6. A sheet feeding apparatus according to claim 4, further comprising an electromagnetic clutch for disengaging the first and second transmission mechanisms.

7. A sheet feeding apparatus according to claim 5, wherein the disengaging mechanism includes:

an arm having a center portion rotatably supported on a shaft of the sun gear and carrying the planetary gears at opposing ends;

a member secured to the arm and having an inclined surface; and a protrusion, provided on the lever, for engaging the inclined surface when the lever is operated to rotate the arm so that the planetary gears are separated from the gears of the supplemental feed roller.

8. A sheet feeding apparatus comprising:

a platen for supporting a sheet paper and rotating in a paper feeding direction when driven by a drive source;

a hopper for retaining a stack of sheet papers, the hopper including a support plate that supports a sheet;

a paper feed roller for separating the sheet papers on the hopper one by one and feeding the individual sheets toward the platen;

a pair of supplemental feed rollers for feeding the sheet paper fed by the paper feed roller therebetween to the platen;

a first transmission mechanism for driving the supplemental feed rollers in the paper feeding direction while the platen is rotating;

a second transmission mechanism for driving the paper feed roller in the paper feeding direction; and and electromagnetic clutch for disengaging the paper feed roller from the second tranmission mechanism, wherein: said supplemental feed rollers being carried by supplemental feed roller shafts; and said hopper having a shaft interval holding means for acting on the supplemental feed roller shafts to inhibit their separation.

9. A sheet feeding apparatus according to claim 8, wherein the shaft interval holding means has an opening and holds the first and second supplemental feed roller shafts at opposing ends of the opening.

10. A sheet feeding apparatus according to claim 9, wherein the shaft interval holding means is provided between the feed roller shaft and the first and second supplemental feed roller shafts.

11. A sheet feeding apparatus according to claim 8 further comprising a manually-operable lever for moving the support plate in a direction away from the paper feed roller.

12. A sheet feeding apparatus according to claim 11, further comprising a disengaging mechanism, provided between the first transmission mechanism and the lever, for transmitting movement of the lever to the first transmission mechanism to disengage the first transmission mechanism from the supplemental feed rollers.

13. A sheet feeding apparatus according to claim 12, wherein:

the first transmission mechanism includes a sun gear and planetary gears designed to engage a first supplemental feed gear coupled to one of the supplemental feed rollers to transmit rotation of the sun gear to the first supplemental feed roller; and when the disengaging mechanism is actuated by operation of the lever, the planetary gears are disengaged from the supplemental feed gear to inhibit the transmission of rotation therebetween.

14. A sheet feeding apparatus according to claim 13, wherein the disengaging mechanism includes:

an arm having a center portion rotatably supported on a shaft of the sun gear and carrying the planetary gears at opposing ends;

a member secured to the arm and having an inclined surface; and a protrusion, provided on the lever, for engaging the inclined surface when the lever is operated to rotate the arm so that the planetary gears are separated from the gears of the supplemental feed roller.

15. A sheet feeding apparatus comprising:

a platen for supporting a sheet paper and rotating in a paper feeding direction when driven by a drive source;

a hopper for retaining a stack of sheet papers, the hopper including a support plate that supports a sheet;

a paper feed roller for separating the sheet papers on the hopper one by one and feeding the individual sheets toward the platen;

a feed roller shaft for holding the paper feed roller movable in an axial direction;

first and second supplemental feed rollers, provided between the paper feed roller and the platen, for feeding the sheet paper, fed by the paper feed roller, to the platen;

first and second supplemental roller shafts extending in parallel to the feed roller shaft, for respectively holding the first and second supplemental feed rollers movable in an axial direction, the paper feed roller and the supplemental feed rollers, being movable on their respective shafts in an interlockingly manner; and a paper feed roller for separating the sheet papers on the hopper one by one and feeding the separated sheet paper toward the platen;

first and second supplemental roller shafts extending in parallel to the feed roller shaft, for respectively holding the first and second supplemental feed rollers movable in an axial direction thereof, the paper feed roller and the supplemental feed rollers, when connected to the side walls, being movable on the feed roller shaft and the supplemental feed roller shafts interlockingly with movement of the side walls;

a first transmission mechanism for transmitting drive force of the drive source as rotation in the paper feeding direction to the supplemental feed rollers while the platen is rotating;

a second transmission mechanism for transmitting drive force of the drive source as rotation in the paper feeding direction to the paper feed roller;

a manually-operable operational lever for moving the support plate in a direction away from the paper feed roller;

a disengaging mechanism, provided between the first transmission mechanism and the operational lever and the transmission mechanism, for transmitting movement of the operation lever to the first transmission mechanism to disengage the first transmission mechanism from the supplemental feed rollers;

an electromagnetic clutch for inhibiting transmission of rotation to the paper feed roller by the second transmission mechanism; and a shaft interval holding means, provided at a vicinity of the first and second supplemental feed rollers, for always keeping an interval between the first and second supplemental feed rollers constant, the shaft interval holding means being movable interlockingly with movement of the side walls.

16. A sheet feeding apparatus according to claim 15, wherein the first transmission mechanism includes a sun gear and planetary gears designed to engageable with gears coupled to one of the supplemental feed rollers to thereby transmit rotation of the sun gear to that supplemental feed roller; and when the disengaging mechanism is actuated by operation of the operational lever, the planetary gears are disengaged from the gears, inhibiting transmission of rotation therebetween.

17. A sheet feeding apparatus according to claim 16, wherein the disengaging mechanism includes:

an arm, supported rotatable at a center portion on a shaft of the sun gear and having the planetary gears at both ends;

a member secured to the arm and having an inclined surface; and a protrusion, provided on the operation lever, for abutting on the inclined surface by operation of the operational lever to rotate the arm so that the planetary gears are separated from other gears.

* * * * *